US005276923A

United States Patent [19]

Cohen

[11] Patent Number: 5,276,923

[45] Date of Patent: Jan. 11, 1994

[54] SHIRT HOLD-DOWN DEVICE

[76] Inventor: Ann Cohen, 42 Bay 25th St., Brooklyn, N.Y. 11214

[21] Appl. No.: 12,756

[22] Filed: Feb. 3, 1993

[51] Int. Cl.[5] ..... A41F 17/00

[52] U.S. Cl. ..... 2/323; 2/111; 2/229; 24/474

[58] Field of Search ..... 2/107, 111, 112, 117, 2/323, 229; 24/464, 470, 471, 472, 473, 474, 475, 476

[56] References Cited

U.S. PATENT DOCUMENTS 2,727,247 12/1955 Bailey ..... 2/117 X
4,937,886 7/1990 Ellis ..... 2/323
5,177,813 1/1993 Bosack et al. ..... 2/323
5,177,814 1/1993 Courtney et al. ..... 2/323

FOREIGN PATENT DOCUMENTS 0206970 5/1955 Australia ..... 24/475

*Primary Examiner*—Clifford D. Crowder
*Assistant Examiner*—Jeanette E. Chapman
*Attorney, Agent, or Firm*—Leon Gilden

[57] ABSTRACT

A central elastomeric web, having concave sides to accommodate an individual's groin area, includes the central web to provide a plurality of tether webs extending longitudinally beyond the central web, with each tether web including a latch fastener for securement to a perimeter portion of an individual's shirt in use.

1 Claim, 4 Drawing Sheets

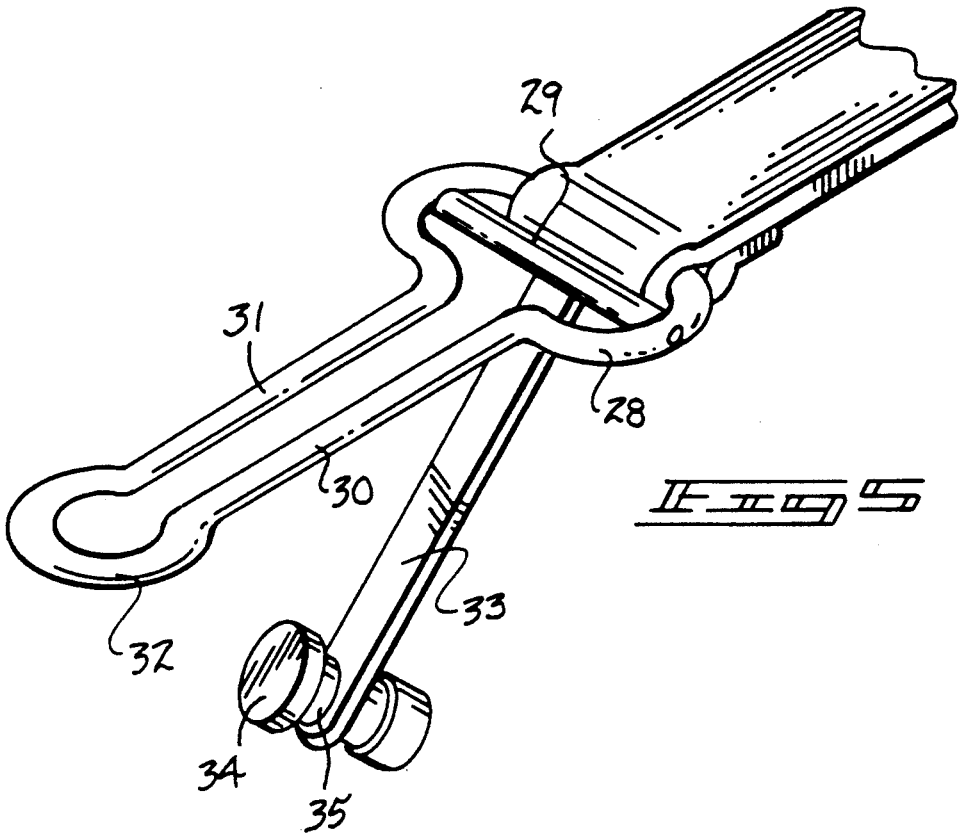
Fig 5
Fig 6
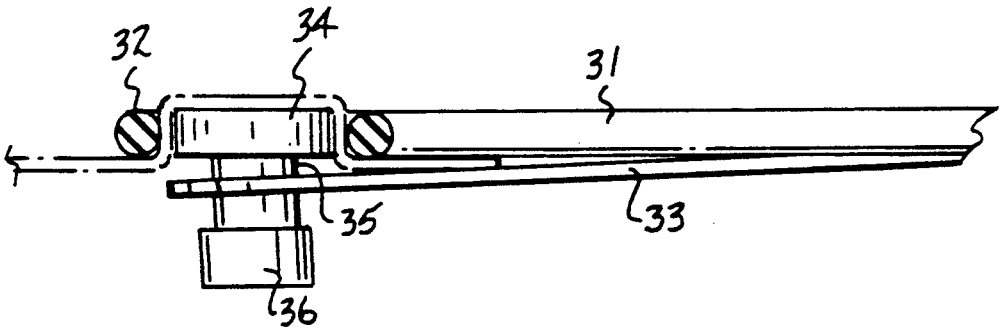
Fig 7
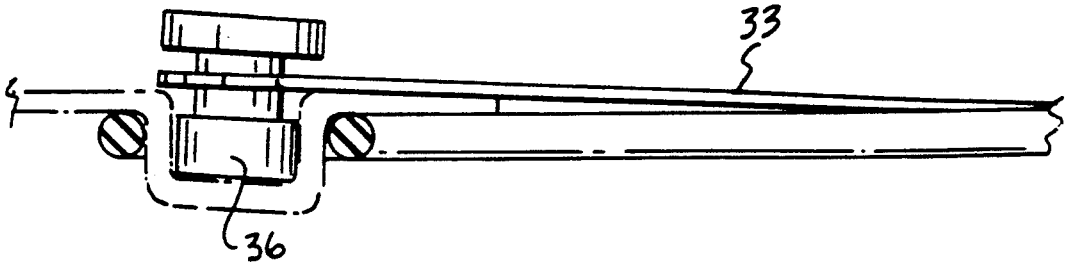

FIG 8
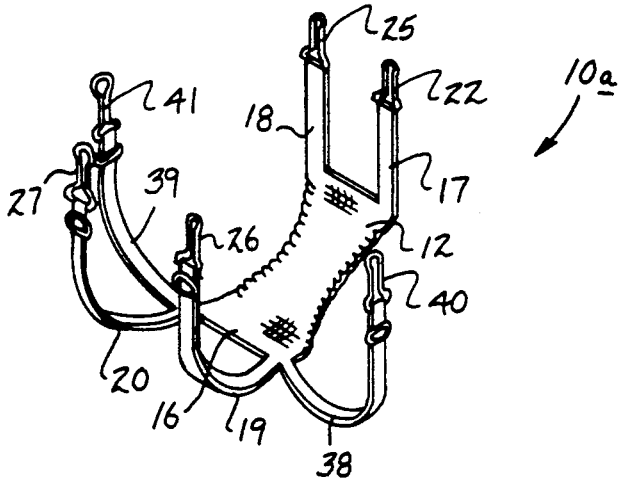
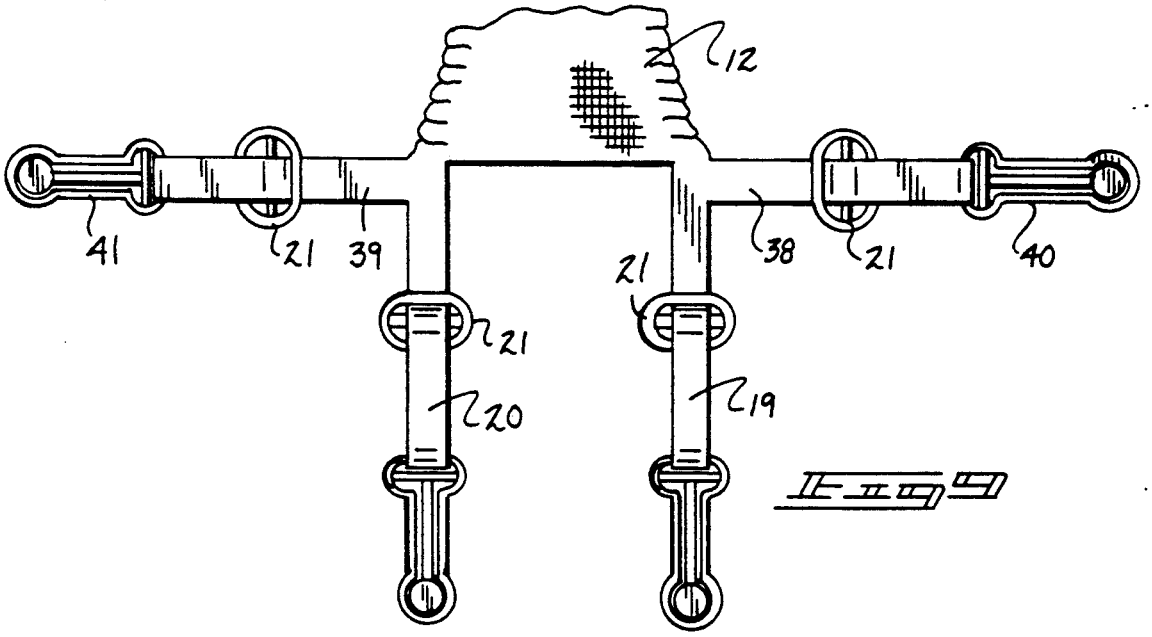
FIG 9

SHIRT HOLD-DOWN DEVICE

BACKGROUND OF THE INVENTION

1. Field of the Invention

The field of invention relates to shirt hold-down structure, and more particularly pertains to a new and improved shirt hold-down device wherein the same is arranged to secure an individual's shirt relative to an individual's waist and groin area.

2. Description of the Prior Art

Prior art shirt hold-down devices are available in the prior art and U.S. Pat. No. 4,596,659 to Campbell indicates the use of a shirt hold-down device for use by an infant arranged to secure the infant's shirt relative to the diaper area.

The instant invention is arranged to employ a shirt hold-down device utilizing a unique fastening structure permitting a combination of a plurality of fabrics relative to shirt usage as an improvement over prior art structure and in this respect, the present invention substantially fulfills this need.

SUMMARY OF THE INVENTION

In view of the foregoing disadvantages inherent in the known types of shirt hold-down structure now present in the prior art, the present invention provides a shirt hold-down device wherein the same is arranged to secure and bias an individual's shirt relative to the individual's groin area. As such, the general purpose of the present invention, which will be described subsequently in greater detail, is to provide a new and improved shirt hold-down device which has all the advantages of the prior art shirt hold-down structure and none of the disadvantages.

To attain this, the present invention provides a central elastomeric web, having concave sides to accommodate an individual's groin area, including the central web to provide a plurality of tether webs extending longitudinally beyond the central web, with each tether web including a latch fastener for securement to a perimeter portion of an individual's shirt in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shirt hold-down device which has all the advantages of the prior art shirt hold-down structure and none of the disadvantages.

It is another object of the present invention to provide a new and improved shirt hold-down device which may be easily and efficiently manufactured and marketed.

It is a further object of the present invention to provide a new and improved shirt hold-down device which is of a durable and reliable construction.

An even further object of the present invention is to provide a new and improved shirt hold-down device which is susceptible of a low cost of manufacture with regard to both materials and labor, and which accordingly is then susceptible of low prices of sale to the consuming public, thereby making such shirt hold-down devices economically available to the buying public.

Still yet another object of the present invention is to provide a new and improved shirt hold-down device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric enlarged illustration of a fastener latch structure employed by the invention.

FIG. 6 is an orthographic view of the fastener latch structure arranged in a first position.

FIG. 7 is an orthographic view of the latch fastener arranged in a second position.

FIG. 8 is an isometric illustration of a modified device structure employed by the invention employing lateral support tether straps and fasteners.

FIG. 9 is an enlarged orthographic view of the structure as indicated in FIG. 8.

DESCRIPTION OF THE PREFERRED EMBODIMENT

Figure 1:
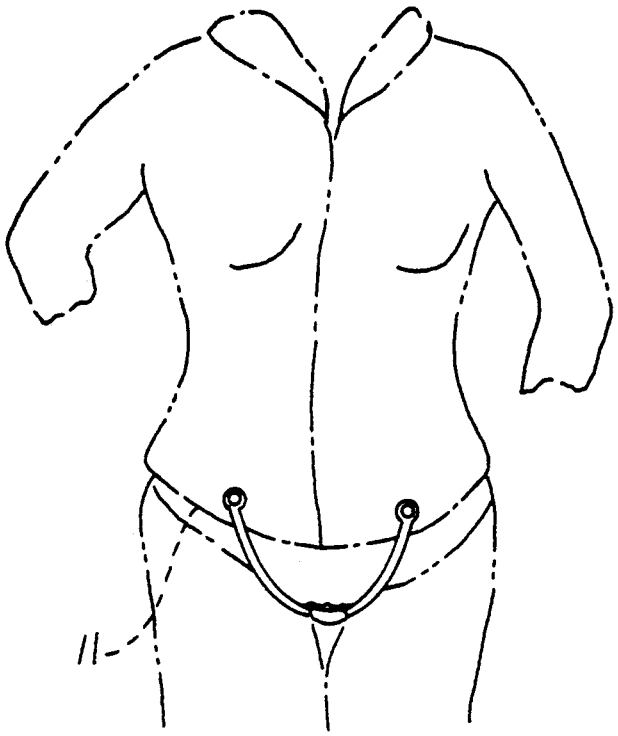
FIG. 1 is an orthographic frontal view of the invention employed by an individual.
Figure 2:
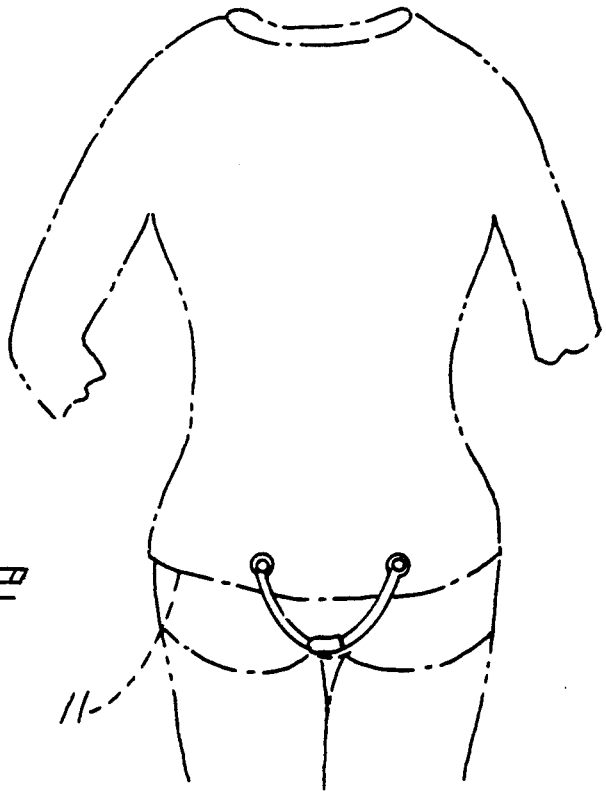
FIG. 2 is a rear orthographic view of the invention employed by an individual.
Figure 3:
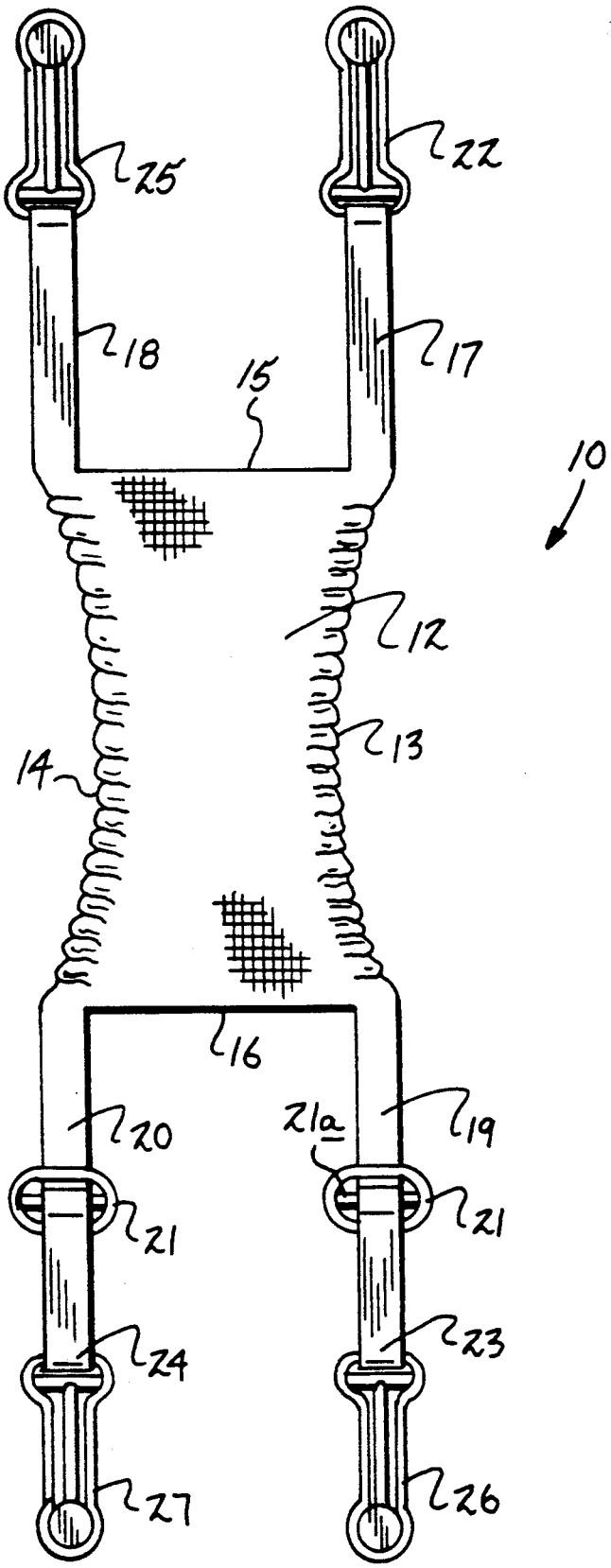
FIG. 3 is an orthographic view of the invention.
Figure 4:
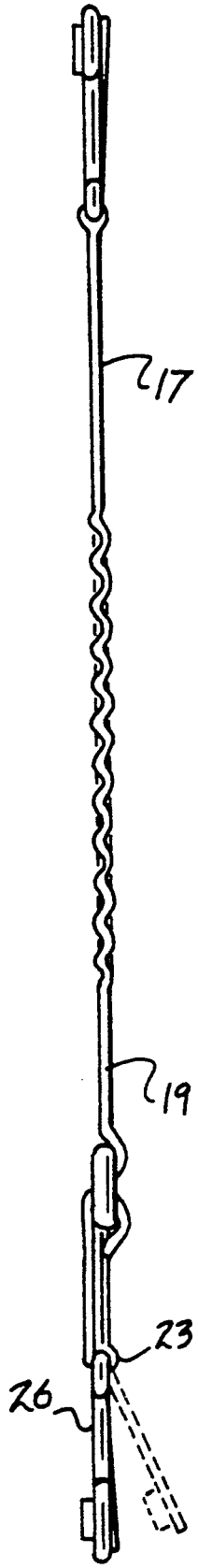
FIG. 4 is an orthographic side view of the invention.

With reference now to the drawings, and in particular to FIGS. 1 to 9 thereof, a new and improved shirt hold-down device embodying the principles and concepts of the present invention and generally designated by the reference numerals 10 and 10*a* will be described.

More specifically, the shirt hold-down device 10 of the instant invention essentially comprises its securement to a shirt lower perimeter 11, with an elastomeric central web 12 directed in communication with an individual's groin area, with the central web 12 having coextensive and concave first and second sides 13 and 14 and a first end 15 spaced from a second end 16. Respective first and second tether webs 17 and 18 that are arranged substantially parallel relative to one another are mounted to the first end 15 in a coextensive relationship, having respective first and second latch fasteners 22 and 25. Third and fourth tether webs 19 and 20 secured to the second end 16 in a parallel relationship have respective third and fourth latch fasteners 26 and 27. The latch fasteners 22, 25, 26, and 27 are of identical configuration and structure. It should be further noted that at least the third and fourth tether webs 19 and 20 include a length adjusting loop 21 having a central bar, with the third and fourth tether webs 19 and 20 directed through the adjusting loop 21 terminating in respective third and fourth respective web loops 23 and 24 that mount the respective third and fourth latch fasteners 26 and 27 (see FIGS. 3 and 4 for example).

Each of the latch fasteners includes a mounting loop 28 secured to a respective tether web, wherein each mounting loop includes a pivot axle, with first and second legs 30 and 31 parallel relative to one another and extend orthogonally relative to the pivot axle terminating in an arresting loop 32. A pivot leg 33 mounted to the pivot axle 29 includes a resilient support boss 35 orthogonally directed through a free distal end of the pivot leg 33, with the support boss 35 having a first latch head 34 at a first end of the support boss of a first diameter, with a second latch boss of a second diameter less than the first diameter mounted to a second end of the resilient boss. In this manner (see FIGS. 5–7), the first boss of the first diameter is employed when using securement to shirts of relative thin thicknesses, such as silk, rayon, and the like, wherein the use of heavier woven shirt fabrics require the use of the second boss of the second diameter to permit securement of the thicker fabrics and their securement within the arresting loop 32. Accordingly, an uninterrupted opening 37 is defined within the arresting loop, between the loop legs 30 and 31, and the pivot axle 29.

The FIGS. 8 and 9 indicate the use of a modified device structure 10*a* that, in addition to the structures noted above, includes respective fifth and sixth tether webs 38 and 39 orthogonally intersecting the respective third and fourth tether webs 19 and 20 at their junction to the second end 16. Respective fifth and sixth latch fasteners 40 and 41 are mounted to the end portions of the fifth and sixth tether webs 38 and 39. The fifth and sixth latch fasteners 40 and 41 permit lateral securement of an individual's shirt to provide for a uniform securement of the shirt within a garment, such as pants, a skirt, and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shirt hold-down device, comprising, a central elastomeric web, having a first end spaced from a second end, a concave first side and a concave second side, and a first tether web and a second tether web fixedly mounted to the first end in a parallel relationship, and a third tether web and a fourth tether web in a parallel relationship mounted to the second end, with a first latch fastener mounted to the first tether web, a second latch fastener mounted to the second tether web, a third latch fastener mounted to the third tether web, and a fourth latch fastener mounted to the fourth tether web, and each latch fastener includes a mounting loop in spaced adjacency to the central web, with the mounting loop having a pivot axle, the pivot axle including a pivot leg, and a first loop leg and a second loop leg arranged in a parallel coextensive relationship directed from the mounting loop, and an arresting loop mounted to the first loop leg and the second loop leg, with an uninterrupted opening directed and extending between the pivot axle, the first loop leg, the second loop leg, and the arresting leg, with the pivot leg having a pivot leg free end spaced from the pivot axle, and the pivot leg free end including a resilient support boss, the resilient support boss including a first head of a first diameter mounted to a first side of the pivot leg, and the support boss further including a second resilient head of a second diameter less than the first diameter mounted to a second side of the pivot leg, wherein the pivot leg, the first latch head, and the second latch head are arranged for reception through the uninterrupted opening, and a fifth tether web orthogonally oriented relative to the third tether web intersecting the third tether web adjacent the second side, with a sixth tether web orthogonally intersecting the fourth tether web adjacent the second side, with the fifth tether web having a fifth latch fastener, and the sixth tether web including a sixth latch fastener.

* * * * *